US005103815A

United States Patent [19]

Siegel et al.

[11] Patent Number: 5,103,815

[45] Date of Patent: Apr. 14, 1992

[54] PERSONAL AIRFLOW GAGE FOR A PERSONAL BREATHING SUPPLY OF RESPIRABLE QUALITY AIR, AND RELATED ACCESSORIES, INCLUDING A TWO WAY COMMUNICATION SYSTEM, USED WHILE WORKING IN CONTAMINATED AIR SPACES

[75] Inventors: John H. Siegel, Des Moines; H. U. Schlapfer, Seattle, both of Wash.

[73] Assignee: Chrislyn Enterprises, Inc., Seattle, Wash.

[21] Appl. No.: 624,497

[22] Filed: Dec. 7, 1990

Related U.S. Application Data

[63] Continuation of Ser. No. 194,033, May 13, 1988, abandoned.

[51] Int. Cl.[5] ..... A62B 7/00

[52] U.S. Cl. ..... 128/205.23; 128/726

[58] Field of Search ..... 73/861.33, 861.75, 861.79; 128/725, 726, 201.19, 201.29, 202.13, 205.23, 202.22

[56] References Cited

U.S. PATENT DOCUMENTS

| | | | |
|---|---|---|---|
| 817,887 | 4/1906 | Tilden | 73/861.79 |
| 820,259 | 5/1906 | Renvoize | 128/726 |
| 859,147 | 7/1907 | Strodtbeck | 128/726 |
| 989,534 | 4/1911 | Macduffee | 242/86 |
| 1,090,742 | 3/1914 | Moran | 128/201.29 |
| 2,098,280 | 11/1937 | Dornseif | 73/861.79 |
| 3,347,229 | 10/1967 | Heitman | 128/201.19 |
| 4,165,738 | 8/1979 | Graves et al. | 128/202.13 |
| 4,265,127 | 5/1981 | Onoda | 73/861.79 |
| 4,269,196 | 5/1981 | Toms et al. | 128/205.24 |
| 4,300,548 | 11/1981 | Jones | 128/204.21 |
| 4,377,163 | 3/1983 | Feathers | 128/205.22 |
| 4,413,622 | 11/1983 | Austin | 128/205.24 |
| 4,516,101 | 5/1985 | Nemoto et al. | 335/208 |

*Primary Examiner*—Edgar S. Burr
*Assistant Examiner*—Aaron J. Lewis
*Attorney, Agent, or Firm*—Shlesinger Arkwright & Garvey

[57] ABSTRACT

Work persons, wearing clear hoods supplied with breathable air, performing tasks in contaminated spaces, are provided with an in line personal airflow gage. The breathable air passing through the gage moves through an especially shaped volume or chamber, which centers on a variable curved interior surface of the underside portions of an inner indicia receiving cover of this personal airflow gage. How this surface is varied serves to initially calibrate this gage. Also initially and subsequently, this gage is calibrated by selecting a coiled spring, which provides the resisting and returning force of the airflow indicating arm or pointer. This arm in turn is coupled to a pivotal air blade, also called the flag, which partially rotates, pivots or deflects, within a one hundred and eighty degree range, back and forth within the especially shaped volume, through which the breathing air passes. When desired, an alarm system is included, whereby, when respective low or high airflows occur, an alarm will sound to warn the work person. Preferably a personal airflow control valve will be located adjacent this personal airflow gage giving the work person greater control of his or her own air supply. Moreover, the air supply hoses may incorporate communication wires to complete a two way communication system between all persons connected with the work tasks in the contaminated space.

22 Claims, 4 Drawing Sheets

PERSONAL AIRFLOW GAGE FOR A PERSONAL BREATHING SUPPLY OF RESPIRABLE QUALITY AIR, AND RELATED ACCESSORIES, INCLUDING A TWO WAY COMMUNICATION SYSTEM, USED WHILE WORKING IN CONTAMINATED AIR SPACES

This application is a continuation of application Ser. No. 07/194,033, filed May 13, 1988, now abandoned.

BACKGROUND

Work persons often must perform important tasks within spaces in which the air is contaminated or soon will be. Therefore, they are supplied with respirable quality air from a source outside of the work space, or they must carry their own controllable air supply. When their air supply is supplied from an outside source, these men and women quite often have found themselves too far away from the important air gages and air valves, when adjustments should be made for their comfort and for avoiding their serious illness. There is a need to provide personal airflow gages and/or airflow controls for the work persons relying on the remote supply of respirable quality air, for delivery to them inside of their clear hood supplied with this respirable quality air.

SUMMARY

A reliable, durable, comparatively light weight, and comparatively low cost, personal air flow gage is provided to a work person for preferable placement on his or her waist belt of a clear hood being supplied with life support air, as the hood is being worn, while tasks are undertaken in an air contaminated space. This personal airflow gage is placed in the overall air line directing respirable quality air from a source located outside of the contaminated space to the interior of the work person's clear hood supplied with the life supporting respirable air. The personal airflow gage is initially calibrated by providing an especially shaped volume for the passing through breathable air, which centers on the variable curved interior surface of the underside portions of an inner indicia receiving cover of the personal airflow gage. Also this gage is initially and subsequently calibrated by selecting a coiled spring, which provides the resisting and returning force of the airflow indicating arm. This arm in turn is coupled to the so called flag or pivotal air blade which partially rotates pivots, or deflects, within a one hundred and eighty degree range, back and forth within the especially shaped volume through which the breathing air passes.

In the minimum embodiment, the airflow must be read by the work person. In a preferred embodiment, an alarm system is included, whereby, upon the occurrence of respective low or high airflows, an alarm will sound to warn the work person.

In addition, accessories are provided, such as an adjacent breathable air valve, whereby the work person may directly adjust his or her air supply. Also the air hose may be made initially with communication wires, and the clear hood assembly will include two way communication equipment, so all the persons involved in the tasks being performed may communicate with one another.

DESCRIPTION OF THE DRAWINGS

The personal airflow gage for a personal breathing supply of respirable quality air, and related accessories, used while working in contaminated air spaces are illustrated in the drawings, wherein.

DESCRIPTION OF THE PREFERRED EMBODIMENTS

The Environment of a Contaminated Work Space and the Embodiments

Figure 1:
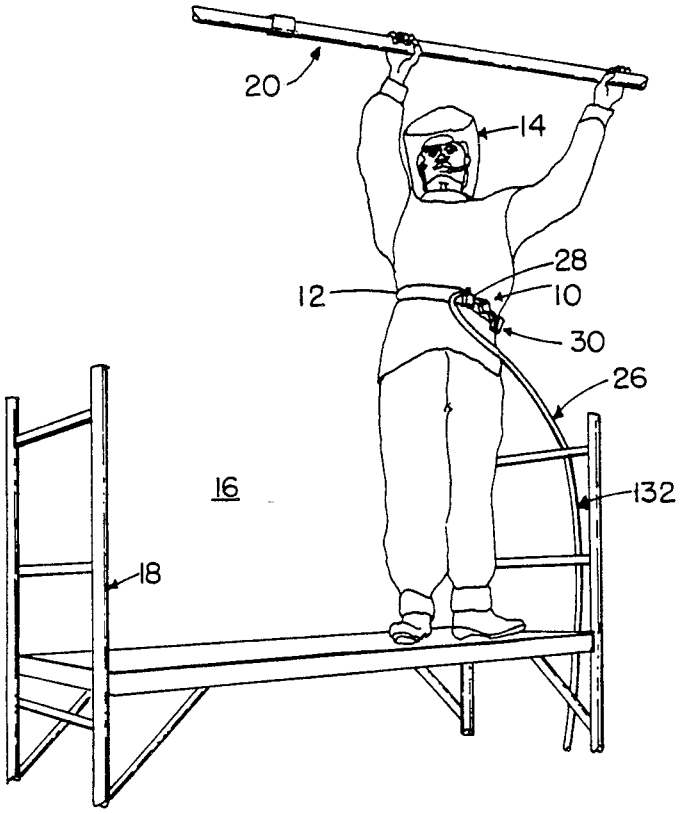
FIG. 1 is a perspective view illustrating a work person, undertaking a task while standing on a work platform in a contaminated air space, requiring the work person to wear a clear hood assembly, to which respirable air is being supplied via an air line, supported by a belt and continuing on up the back of the work person and into the interior of the clear hood assembly for distribution after passing through a muffler and diffuser, with the belt supporting the assembly of a personal air valve, a personal airflow gage, and an alarm.

The personal airflow gage 10, for a personal breathing supply of respirable quality air is preferably placed on a belt 12 of clear hood assembly 14 worn by a work person, who is performing a task, often a difficult one, within a contaminated air space 16, as shown in FIG. 1. Moreover, he or she is also working on staging or scaffolding 18, adding to his or her inconvenience. The work person may, for example, be working to remove asbestos materials from pipes 20.

If the work person relies completely on a person outside 22, of the contaminated air space 16, to regulate the supply of his or her personal supply of breathing air, there may be times when such outside regulated personal air supply 24 is not being maintained properly to meet the respirable air supply needed by the work person. If so, the work person must stop work and leave the contaminated air space 16, to reach an outside space 22 of non contaminated air.

Figure 2:
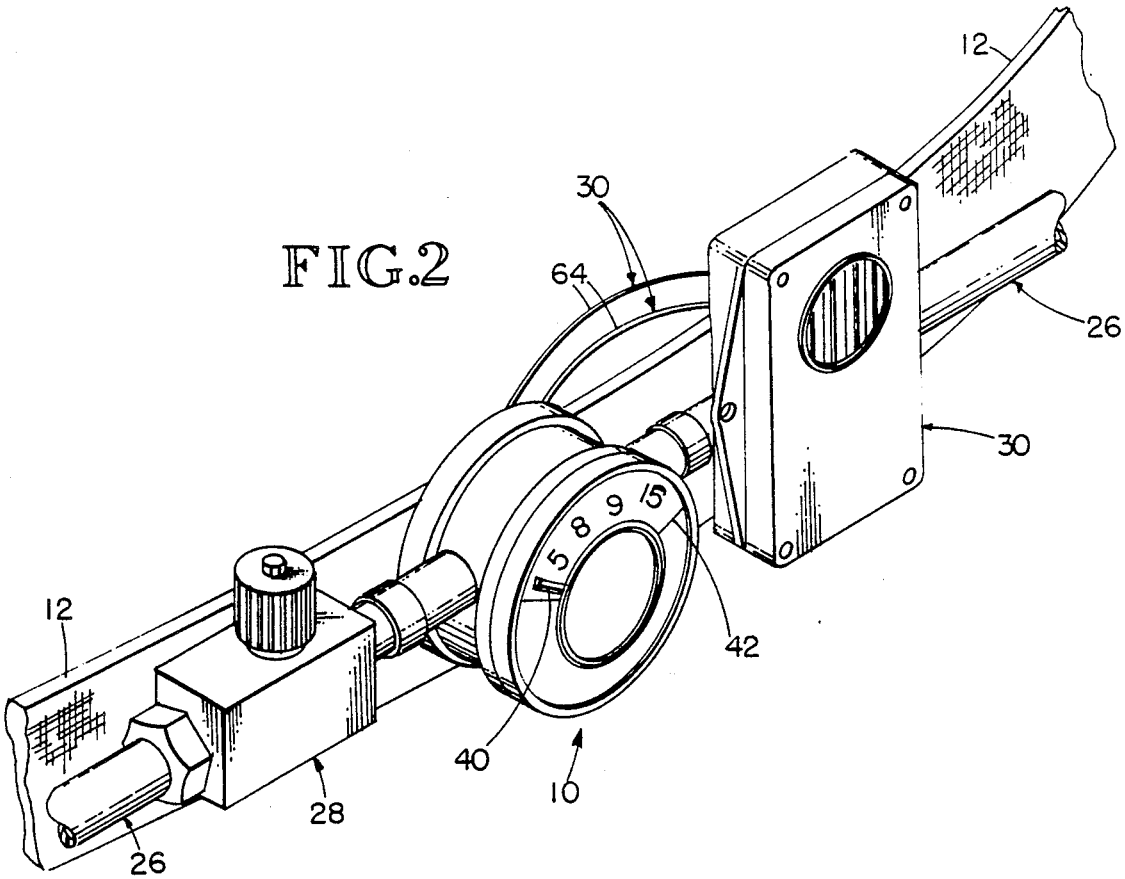
FIG. 2 is a perspective view of the work person's belt, which holds in place the clear hood assembly, and which also supports the air line, a personal air valve, a personal airflow gage, and an alarm.

Therefore, as a start in helping a work person to realize sooner that he or she may be in need of adjustments to his or her air supply, a personal airflow gage 10 is placed within the air line 26 of respirable air and this air line 26, in part, and gage 10 are preferably supported on the belt 12, as shown in FIGS. 1 and 2.

Moreover, to give greater control to a work person, his or her personal airflow valve 28 is placed within the air line 26 adjacent to the personal airflow gage 10, as shown in FIGS. 1 and 2.

Then, in addition, as shown in FIGS. 1 through 5, an alarm system 30, is also supported on the belt 12 and within the personal airflow gage 10. When a selected low airflow is reached, or when a selected high airflow is reached, an alarm will sound to warn the work person. He or she will adjust their personal airflow valve 28 to make the correction, or if the supply of respirable air is failing at the outside regulated air supply 24, then he or she will exit the contaminated air work space as soon as possible.

Figure 6:
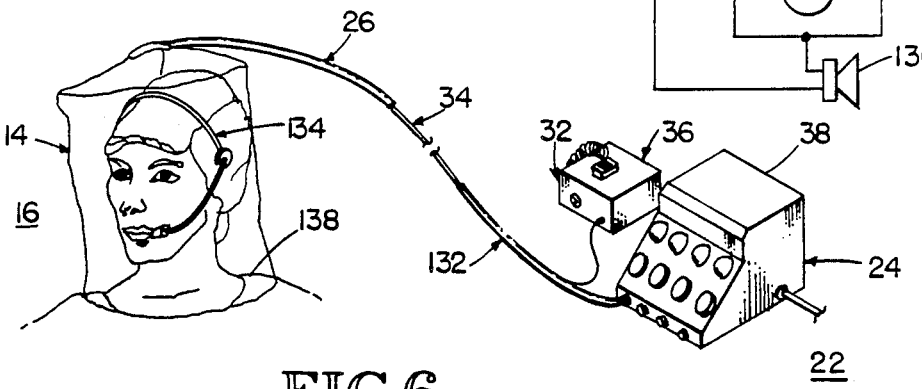
FIG. 6 is a schematic perspective view of a respirable air supply which incorporates a communication system, commencing from a location outside a contaminated work space and ending within the clear hook assembly worn by the work person in the contaminated work space, inclusive of the air line having inside communication circuitry, and showing the side by side communication console and the breathing air manifold with controls.
Figure 8:
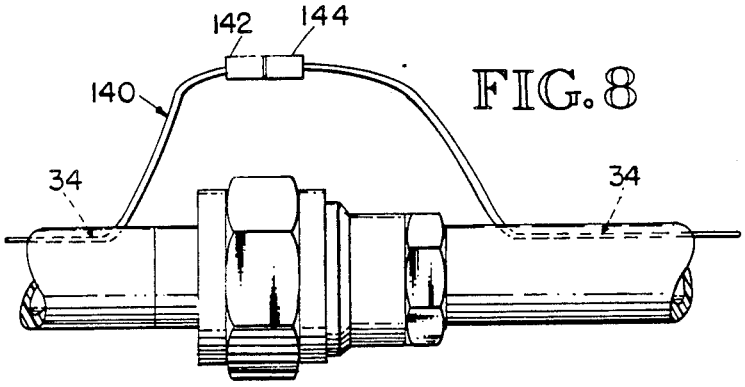
FIG. 8 is a side view of airflow line at a connection location to illustrate how a two way communication system is connected to continue the communication circuitry, which is included in the airflow line at the time of its manufacture.
Figure 9:
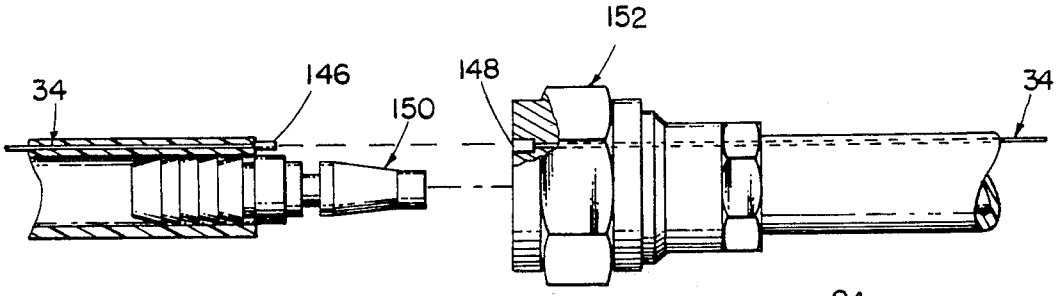
FIG. 9 is a side view of the airflow line at a connection location to illustrate how a two way communication system is connected to continue the communication circuitry, which is included in both the airflow line and these connectors at the time of their manufacture.

To continue to complete the personal control a work person will have, a two way communication system 32 is provided, as illustrated in FIG. 6. The air line 26 of respirable air will include internally the communication circuitry 34, extending between clear hood assembly 14 and the communication console 36, located outside 22 of the contaminated air space 16, where the breathing air manifold 38 is also located. As shown in FIGS. 8 and 9, the communication circuitry 34 is molded into the material of the air line 26.

As each of these embodiments is utilized in various combinations of embodiments, the safety of the work person is progressively enhanced. Each work person gains more self confidence in his or her ability to control his or her air supply, and then, if necessary, to learn more quickly, that he or she must leave the contaminated air space, in which the tasks are being performed.

The Personal Airflow Gage

The personal airflow gage 10, is shown in FIGS. 1 and 2 in the preferred position supported on belt 12 of the clear hood assembly 14. Upon a downward glance, with or without a slight twisting of the belt 12, the work person may read the airflow, so indicated by the relatively steadily deflected pivotal position of the pointer or hand 40 over the airflow scale 42 of this personal airflow gage 10.

Figure 3:
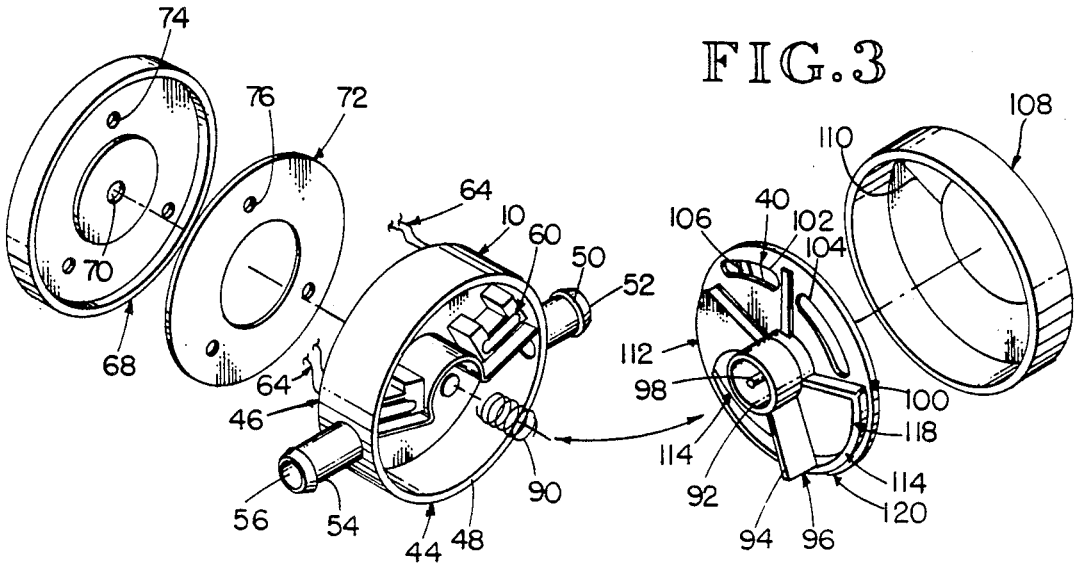
FIG. 3 is a perspective exploded view to illustrate the components of the personal airflow gage, indicating an embodiment which includes portions of an alarm system for signaling a selected respective low and/or high airflow.
Figure 4:
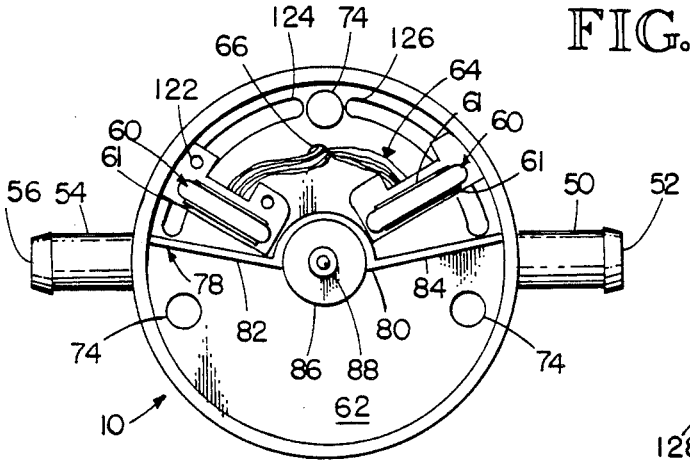
FIG. 4 is a view of the interior of the personal airflow gage, with portions of the indicator assembly removed from the principal space thereof, showing, however, the positioning of reed switches at selected low and high airflow positions in the secondary space thereof, and indicating the air inlet and exit connections, adjustment portions of the disc base, and fastener receiving portions of the central cylindrical portion of the multiple portion housing of this personal airflow gage.

The arrangement of the several components of the personal airflow gage 10 is illustrated in FIGS. 3 and 4. A multiple portion housing 44, has a central cylindrical portion 46. Within this central portion 46 is a principal space 48 through which the breathable air passes. This air enters through the air line connector 50 having a central passageway 52, and this air leaves through a similar on line connector 54 having a central passageway 56.

Also this central portion 46 has a secondary space 58 in which reed switches 60 are adjustably positioned on a disc base 62 which is an integral portion of this central portion 46. Alarm circuitry 64 of the alarm system 30 extends from the reed switches 60 and out through a hole 66 in this disc base 62 and beyond to pass through a back cover 68, via a subsequently sealed exit 70.

Upon assembly of the back cover 68 a gasket 72 is inserted between this cover 68 and the central cylindrical portion 46. These components are then secured by fasteners, not shown, passing in part through the back cover 68, via holes 74, the gasket 72, via holes 76, and terminating in threaded receivers 74, spaced apart on the disc base 62 of the central cylindrical portion 46, as shown in FIG. 2.

The principal space 48 and the secondary space 58 of the central cylindrical portion 46 of the multiple portion housing 44 of the personal airflow gage 10, are on respective sides of transverse partition 78, which has a midway arcuate portion 80 and two partial radial portions 82, 84. The arcuate portion 80 provides a recess 86 about an upstanding stepped bearing 88, which is an integral portion of the disc bare 62, as shown in FIGS. 3 and 4.

A selectable strength coiled spring 90 is positioned in the recess and secured between the disc base 62 and an integral cylindrical portion 92 of a blade 94 or flag 94, which are components of an airflow indicator assembly 95. Calibration of this personal airflow gage 10 may be undertaker by selection of a particular coiled spring 90. Other components of this airflow indicator assembly 96, are a shaft 98, a bearing, not shown, and the pointer or indicator 40. The shaft 98 is rotatably supported by the stepped bearing 88 of the disc base 62 and by the bearing, not shown, positioned in a center hole, not shown, in the indicia receiving inner cover 100. This inner cover 100 is secured to the central cylindrical portion 46. When reed switches 60 are used in an alarm circuitry 64, this inner cover 100 has two arcuate openings 102, 104, whereby a shielded magnetic 106, on the underside of the pointer, hand, or indicator 40 becomes more effective in conjunction with changing the magnetic flux field about the reed switches 60.

An outer cover 108, having a clear portion 110, is placed over the indicia receiving inner cover 100, and fitted to the central cylindrical portion 46, completing the multiple portion housing 44, of the personal airflow gage 10.

The Calibration Air Flow Chamber

Figure 11:
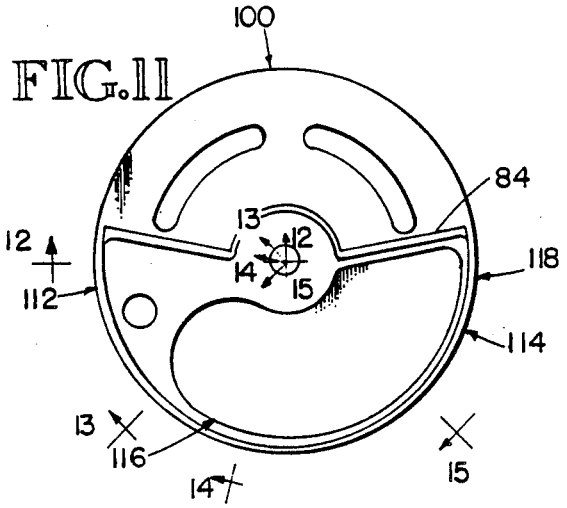
FIG. 11 is an underside view of indicia receiving inner cover to illustrate calibration airflow chamber.
Figure 12:
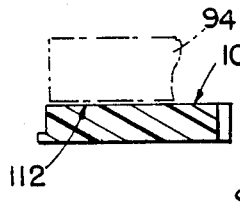
Figure 13:
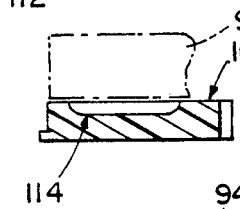
Figure 14:
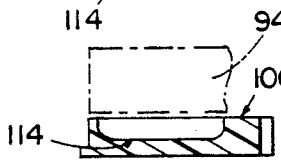
Figure 10:
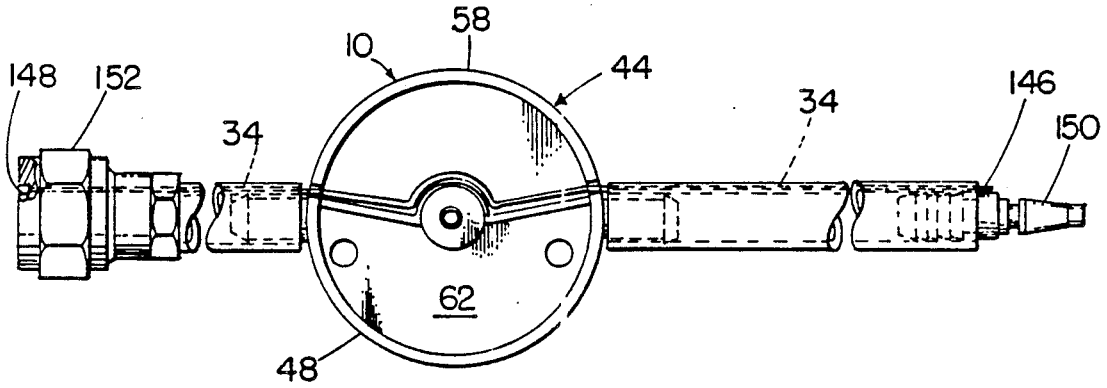
FIG. 10 is a view, with portions removed, to illustrate how the communication circuitry is completed trough the personal airflow gage and the adjacent air line and air line connectors.

When the respirable air is flowing at flow rates upon entering the central passageway 52 of connector 50, the near entry cross sectional areas 112 are smaller as shown in FIGS. 3, 11, 12, 13, 14, and 15. This insures that the resultant of the airflow force will be sufficient in acting against the blade or flag 94 of the airflow indicator assembly 96, so the pointer 40 will pivot or deflect to a location within a one hundred eighty degree range to indicate an accurate low airflow reading, which is linear, on the airflow scale 42. These near entry cross sectional areas 114 are thereafter increased in graduations at the location 116, eventually being phased out and reaching maximum cross sectional areas 118, so the airflow readings remain linear. Preferably, these cross sectional area changes are undertaken by contour forming the underside 20 of the indicia receiving inner cover 100, over the principal space 48. This contouring of the underside 120 is illustrated in FIG. 11 as the contoured underside 120 is directly observed. Then in reference to the various radial section lines 12—12, 13—13, 14—14, and 15—15, shown in FIG. 11, FIGS. 12 through 15 illustrate this changing contour in conjunction with the changing radially positions of the blade or flag 94, as the calibration airflow chamber cross sectional areas are shown as they become larger. The initial calibrations, and, as necessary, subsequent calibrations, are undertaken by this contour forming of the underside 120 of this cover 100. Also coiled spring 90 changes may be undertaken during calibrations of this personal airflow gage 10, whereby accurate airflow observations may be made by the work person, who is observing the airflow scale 42 and the position of the pointer 40.

The Low and High Airflow Alarm System

Figure 5:
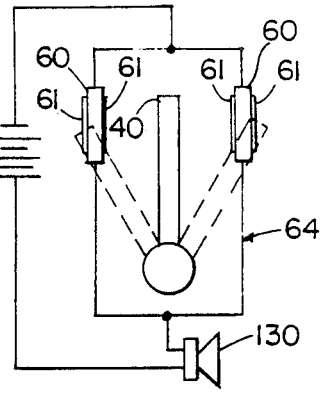
FIG. 5 is a schematic circuit diagram of the battery energy supplied alarm circuit which is actuated when the indicator with the shielded magnet passes over the reed switches located in the secondary space of the personal airflow gage.

When a work person is trying to complete a rushed tank, he or she may not be too observant of the personal airflow gage 10. Therefore, a low and high airflow alarm system 30 is included, as shown in FIGS. 3, 4, and 5. Preferably reed switches 60 are selectively positioned using fasteners 122, and arcuate openings 124, 126, in the disc base 62 of the central cylindrical portion 46 Then as shown in FIG. 5, when the pointer, hand, or indicator 40, with the underside magnet 106, moves over a respective reed switch 60, than a battery 128 energy supplied alarm circuitry 64 will be closed and the alarm system 30 will be effectively creating an alarm via speaker or horn 130 indicating either a too high or too low respirable airflow.

Whenever the personal airflow gage 10 is initially used as the commencement of each task, the work person will understand that a low air supply alarm signal must be heard. This alarm tells the work person that the battery energy supply is good at the outset of this working time. If no alarm is heard, the battery must be checked, exchanged, or other steps undertaken to make sure the low and high airflow alarm system is working.

Immediately adjacent each reed switch are metal strips 61, as shown in FIG. 4. The presence of these metal strips insures a sharp commencement and release of the reed switches 60, creating a more precise alarm period. These metal pieces 61 modify the magnetic flux pattern, as the pointer 40 with the magnet 106, approaches, passes over, and leaves the location of a reed switch 60.

A Voice Communication System

In FIG. 6, a two way voice communication system 32, is illustrated in conjunction with the respirable air system 132. When these systems 32 and 132 are combined along with the alarm system 30, the work person may concentrate better on getting his or her task done. He or she will know, that if there is an approaching failure, or a failure of the respirable air, his or her chance of taking the necessary corrective actions quickly is greatly enhanced.

Figure 7:
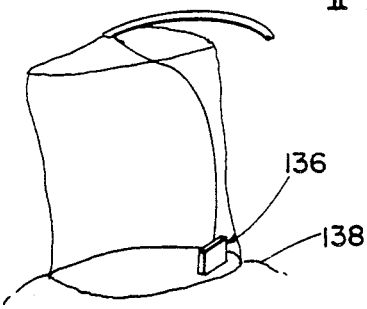
FIG. 7 is a partial perspective view of a work person wearing the clear hood which is equipped with a two way communication system utilizing a two way speaker positioned on his or her inside garment.
Figure 15:
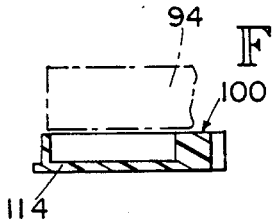
FIGS. 12, 13, 14, and 15, are partial sectional views taken along the radial section lines 12—12, 13—13, 14—14, and 15—15, of FIG. 11 to further indicate the changing cross sections of the underside of the indicia receiving inner cover, which, when being formed, serve in the calibration of the airflow chamber, and the blade or flag is shown to indicate how the flow channel cross sections are changing in reference to the changing positions of the blade or flag.

In this two way communication system 32 the work person may wear the head set 134, or have a two way speaker-receiver 136 secured to a garment 138, as shown in FIG. 7.

In respect to the preferred utilization of communication circuitry 34 incorporated outset within the air line 26 during their manufacture. When a connection location is reached, the communication circuitry 34 is continued on by using a by-pass circuit 140 having connectors 142, 144, as sown in FIG. 8. Preferably, however, the connectors will be manufactured initially to include the communication circuitry 34 and related connectors 146, 148, as shown in FIG. 9, which are included in the male and female air line connectors 150, 152. As shown in FIGS. 8 and 9, the communication circuitry 34 is molded into the material of the air line 26.

This two way wired communication system 32 is preferred over the utilization of wireless head sets, not shown. During use of a wireless communication system, the various interfering sounds become troublesome, and often relay amplifies are needed and often they are not adequate.

High Air Pressure Relief

On that rare occasion when a surge of high air pressure may occur, the back cover 68, at locations between the fasteners, is designed to distort sufficiently to provide high air pressure relief. In this way this personal airflow gage 10 is said to be self relieving.

The Utilization of the Personal Airflow Gage and Accessories With Other Respirators Although the utilization of the personal airflow gage 10 has been illustrated in conjunction with a respirator clear hood assembly 14, being worn by a work person, this airflow gage and accessories are useful when other respirators are being relied upon by a work person, such as a respirator face mask.

We claim:

1. A personal airflow gage for a personal breathing supply of respirable quality air, used while working in contaminated air spaced, comprising:

a) a housing having a principal volume through which breathable air passes;

b) air line connectors made integrally with the housing having an airflow interior and an air line receiving exterior;

c) an indicator assembly adapted for central mounting in the housing, having; a center shaft, a blade secured to this center shaft and arranged for rotative movement throughout the principal volume, and an indicator secured to this center shaft above the blade level for rotative movement over indicia indicating airflow; and d) a calibrated spring means is located about the center shaft and secured between said blade and said housing.

2. A personal airflow gage, as claimed in claim 1, wherein the principle volume of the housing is contoured in changing the cross sectional areas thereof to create lineal reading movements of the indicator assembly components, whereby ,through these changing volumes cross sectional areas, airflow readings of this personal airflow gage will be helpful to those persons being supplied with respirable air in contaminated locations.

3. A personal airflow gage, as claimed in claim 1, wherein the housing also has a secondary volume, and electrical switches are selectively spaced within this secondary volume to become active, when respirable airflow becomes either too low or too high, and circuitry is selectively placed within this secondary space and connected to these switches, and then directed out through the housing.

4. A personal airflow gage, as claimed in claim 2, wherein the housing also has a secondary volume, and electrical switches are selectively spaced within this secondary volume to become active, when respirable airflow becomes either too low or too high, a magnet is placed on the underside of the indicator and as the indicator passes over an electrical switch it becomes active, an alarm circuit having circuitry, a battery, and an alarm, wherein the circuitry is connected between the electrical switches, battery, and alarm, and when the indicator passes over an electrical switch the alarm sounds.

5. A personal airflow gage, as claimed in claim 1, wherein two way communication circuitry is incorporated in the housing and extends to the terminuses of the air line connectors.

6. A personal airflow gage, as claimed in claim 5, wherein air lines, having two way communication circuitry incorporated therein, are connected to the connectors of the housing.

7. A personal airflow gage, as claimed in claim 2, wherein the air lines extend from a respirable air source in a noncontaminated space, via the personal airflow gage, to a respirator being used in a contaminated space, and consequently via the communication circuitry having two way speakers at each end, supply respirable air to a work person, and as necessary, keep him or her informed of necessary information while performing tasks in the contaminated space.

8. A personal airflow gage, as claimed in claim 2, wherein two way communication circuitry is incorporated in the housing and extends to the terminuses of the air line connectors.

9. A personal airflow gage, as claimed in claim 8, wherein air lines, having two way communication circuitry incorporated therein, are connected to the connectors of the housing.

10. A personal airflow gage, as claimed in claim 9, wherein the air lines extend from a respirable air source in a noncontaminated space, via the personal airflow gage, to a respirator being used in a contaminated space, and consequently via the communication circuitry having two way speakers at each end, supply respirable air to a work person, and as necessary, keep him or her informed of necessary information while performing tasks in the contaminated space.

11. A personal airflow gage for a personal breathing supply for use while working in contaminated air spaces, said gage comprising:

a) housing means forming an enclosure;

b) said housing means having a front cover having a front wall, a back cover having a back wall, and a central portion;

c) said central portion having first wall mans for forming said enclosure when said first wall means is connected to said front cover and said back cover;

d) said central portion also includes a transverse partition extending across said enclosure substantially perpendicularly to said front wall and said back wall for dividing said enclosure into an airflow chamber and a second chamber;

e) said central portion has an inlet air line connection means and an outlet air line connection means for facilitating airflow through said airflow chamber;

f) an indicator assembly is positioned within said housing means and has a pivotable, biased deflecting means in said air-flow chamber;

g) said indicator assembly further including means responsive to said deflecting means for indicating airflow through said air-flow chamber to measure air flow through said air-flow chamber from said inlet air line connection means to said outlet air line connection means.

12. The personal airflow gage as set forth in claim 11, wherein:

a) said deflecting means is spring biased.

13. The personal airflow gage as set forth in claim 12, wherein:

a) said biasing spring is calibrated.

14. The personal airflow gage as set forth in claim 11, wherein:

a) said deflecting means includes a pivotable blade extending across said airflow chamber;

b) whereby, as airflow increases through said airflow chamber, said blade pivots to create a larger airflow area.

15. The personal airflow gage as set forth in claim 11, wherein:

a) an indicator pointer is directly connected to said deflecting means and is pivotable to indicate high and low airflows.

16. The personal airflow gage as set forth in claim 15, wherein:

a) said second chamber includes electrically activated alarm means which is activated in response to movement of said indicator pointer.

17. The personal airflow gage as set forth in claim 16, wherein:

a) said indicator pointer includes a magnet for activating said alarm means.

18. The personal airflow gage as set forth in claim 11, wherein:

a) a sealing means is located between said back cover and said central portion for providing an airtight gasket between said back cover and said central portion.

19. The personal airflow gage as set forth in claim 18, wherein:

a) said back cover is sufficiently flexible to allow release of air around said seal means to vent said housing means during a condition of high air pressure in the airflow gage.

20. A personal airflow gage and communications system for use while working in contaminated air spaces, said system comprising:

a) housing means forming a chamber;

b) said housing means having a front cover having a front wall, a back cover having a back wall, and a central portion;

c) said central portion having first wall mans for forming said enclosure when said first wall means is connected to said front cover and said back cover;

d) said central portion also includes a transverse partition extending across said enclosure substantially perpendicularly to said front wall and said back wall for dividing said enclosure into an airflow chamber and a second chamber;

e) said central portion has an inlet air line connection means and an outlet air line connection means for facilitating airflow through said airflow chamber;

f) an indicator assembly is positioned within said housing and has a biased deflecting means in said air chamber which is pivotable in response to air flowing through said air chamber from said inlet air line connection means to said outlet air line connection means;

g) said indicator assembly further including means responsive to said deflecting means for indicating airflow through said air chamber to measure air flow through said air chamber from said inlet air line connection means to said outlet air line connection means;

h) first and second air lines;

i) said first air line being connected to said inlet air line connection means and said second air line being connected to said outlet air line connection means;

j) each of said first and second air lines including signal transmission means therein, and;

k) each of said inlet and outlet air line connection means including signal transmission means.

21. The system as defined in claim 20, wherein:

a) said signal transmission means is formed in said air lines a unitary part thereof.

22. The system as defined in claim 20, wherein:

a) said system includes connector for connecting signal transmission means together to form a continuous circuit.

* * * * *